United States Patent [19]

Hilfman et al.

[11] 4,405,447

[45] Sep. 20, 1983

[54] METHOD FOR THE REMOVAL OF METAL FROM A HYDROCARBON SOLUTION CONTAINING METAL ALKARYL SULFONATE

[75] Inventors: Lee Hilfman, Mt. Prospect; John G. Gatsis, Des Plaines, both of Ill.

[73] Assignee: UOP Inc., Des Plaines, Ill.

[21] Appl. No.: 358,074

[22] Filed: Mar. 15, 1982

[51] Int. Cl.[3] ..... C10G 19/02

[52] U.S. Cl. ..... 208/251 R; 208/237

[58] Field of Search ..... 208/251 R, 237; 166/266, 267

[56] References Cited

U.S. PATENT DOCUMENTS

| | | | |
|---|---|---|---|
| 3,107,726 | 10/1963 | Greenwald | 166/266 |
| 4,274,943 | 6/1981 | McClaflin | 208/181 |

FOREIGN PATENT DOCUMENTS

| | | | |
|---|---|---|---|
| 2267361 | 12/1975 | France | 208/251 R |
| 580156 | 9/1976 | Switzerland | 208/251 R |

*Primary Examiner*—Delbert E. Gantz
*Assistant Examiner*—Cynthia A. Prezlock
*Attorney, Agent, or Firm*—James R. Hoatson, Jr.; John G. Cutts, Jr.; William H. Page, II

[57] ABSTRACT

A method for the removal of metal from a hydrocarbon solution containing metal alkaryl sulfonate. Briefly, the method comprises contacting the hydrocarbon solution containing metal alkaryl sulfonate with an aqueous ammonia or an aqueous ammonium salt solution and recovering a hydrocarbon having a reduced metal concentration.

8 Claims, No Drawings

METHOD FOR THE REMOVAL OF METAL FROM A HYDROCARBON SOLUTION CONTAINING METAL ALKARYL SULFONATE

BACKGROUND OF THE INVENTION

The method described herein is applicable to the removal of metal from a hydrocarbon solution of metal alkaryl sulfonate. A typical hydrocarbon which is contaminated with such metal alkaryl sulfonates is petroleum crude oil.

Aqueous solutions containing metal alkaryl sulfonates are used in the enhanced oil recovery (EOR) of petroleum crude oil from subterranean formations. The petroleum crude oil is recovered concurrently with an aqueous phase and after the separation of the aqueous phase from the crude oil, a substantial amount of metal sulfonate remains in the crude oil portion. The crude oil may be contaminated with sulfonates in an amount from about 10 to 5000 parts per million by weight, or more. The metal alkaryl sulfonates are often referred to as surfactants. The metal which is associated with the sulfonate and which contaminates the recovered crude oil must be removed or substantially reduced before the crude oil undergoes any further refining and processing. The presence of metal in the crude oil during subsequent processing may cause corrosion, environmental pollution and/or hydrorefining catalyst poisoning. The class of sulfonates most useful in enhanced oil recovery applications is the sodium petroleum sulfonates. Any surfactant present in the produced oil will accompany that oil and will be processed in the refinery as part of the crude oil. Processing of EOR crude oil containing surfactants especially sodium petroleum sulfonates will be detrimental to the refinery catalyst by causing severe deactivation. It is believed that deactivation occurs from the deposition of the metal, and sodium in particular, of the surfactant on the surface of the catalyst which unfavorably alters the performance of the catalytic sites.

Since enhanced oil recovery is becoming widespread in the oil production industry, the problem of surfactant contaminated crude oil is well known. Candor compels the acknowledgement that those skilled in the art are working in many directions to solve the problem. For example, U.S. Pat. No. 4,274,943 (McClaflin) teaches a method for the removal of metal alkaryl sulfonates from a hydrocarbon solution threof which method comprises (a) contacting the hydrocarbon solution containing metal alkaryl sulfonates with an aqueous basic solution containing a "recovery" surfactant, (b) forming a hydrocarbon phase and an aqueous phase containing metal alkaryl sulfonates and (c) separating the hydrocarbon phase and the aqueous phase. U.S. Pat. No. 4,274,943 is one method which the prior art utilizes to separate or extract metal alkaryl sulfonates from recovered petroleum crude oil and is incorporated herein by reference thereto.

As hereinabove described, the inventor in U.S. Pat. No. 4,274,943 has chosen to remove the entire metal alkaryl sulfonate molecular component from the crude. In stark contrast, we have discovered a novel and effective method for the removal of the metal portion of the metal alkaryl sulfonate and substituting in place of the metal component a relatively innocuous substance to preserve the molecular integrity of the sulfonate. Since the metal is effectively removed from the crude oil, the possibility of catalyst deactivation resulting from the presence of a metal component and any other potential difficulties are alleviated. The method of the present invention will be described in detail hereinafter.

BRIEF SUMMARY OF THE INVENTION

The present invention relates to a method for the removal of metal from a hydrocarbon solution containing metal alkaryl sulfonate. Accordingly, one embodiment of the present invention is a method for the removal of metal from a hydrocarbon solution containing metal alkaryl sulfonate, which method comprises: (a) contacting a hydrocarbon solution of metal alkaryl sulfonate with an aqueous ammonia or an aqueous ammonium salt solution; and (b) recovering a hydrocarbon having a reduced metal concentration.

Other embodiments and objectives of our invention encompass details about sulfonates, aqueous ammonia, ammonium salts, aqueous ammonium salt solutions, preferred hydrocarbons, and operating conditions, all of which are hereinafter disclosed in the following discussion of each of the facets of the invention.

DETAILED DESCRIPTION OF THE PRESENT INVENTION

The present invention comprises steps for the removal of metal from a hydrocarbon solution of metal alkaryl sulfonate. More specifically the invention concerns the removal of metal from petroleum crude oil which has been recovered by use of tertiary oil recovery techniques. Tertiary recovery or what may be referred to as enhanced oil recovery (EOR) is the extraction of crude oil which remains in place after the primary oil recovery and secondary oil recovery with water in an oil field are completed. One method for enhanced oil recovery is to flood the subterranean formations with an aqueous solution of metal alkaryl sulfonate and to remove the crude oil. As hereinabove described, the recovered petroleum crude oil contains trace quantities of metal sulfonates. Although the method of the present invention may be utilized for the removal of metal from hydrocarbons in general, the preferred hydrocarbons are the petroleum crude oils which have been contaminated with metal sulfonates during an enhanced oil recovery procedure. However, our process is also applicable to liquid hydrocarbons, either pure or mixtures thereof, containing from about 6 to about 18 carbon atoms. The hydrocarbons can be straight-chain or branched-chain.

Many different types of metal alkaryl sulfonates may be employed for the enhanced oil recovery of petroleum crude oil. One type of metal alkaryl sulfonates is represented by the following formula:

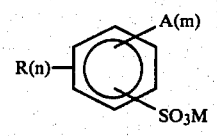

wherein

A = hydrogen or a $C_1$–$C_4$ alkyl group m = 1 or 2 when A is alkyl

R = $C_9$–$C_{18}$ alkyl group n = 1 or 2

M = alkali metal when A is hydrogen, m = 1 when A is alkyl the maximum number of carbon atoms in A is 4, and the total number of carbon atoms in A(m) and R is in the range of 12 to 22.

One particular sulfonate is a sodium mono- or dialkyl benzene sulfonate wherein the alkyl group contains from 9 to 18 carbon atoms. Another sulfonate is a sodium dialkyl benzene sulfonate with an average equivalent weight of 430. Although a myriad of metal alkaryl sulfonates and mixtures thereof having the above formula exist and may be used for enhanced oil recovery, the present invention may be used to remove any of the metal associated with metal alkaryl sulfonates from hydrocarbons. Hydrocarbons suitable for use with the present invention preferably contain from about 10 to about 10,000 wt. ppm metal alkaryl sulfonate.

The process of the present invention utilizes an aqueous ammonia or an aqueous ammonium salt solution to effect the removal of metal from a hydrocarbon solution containing metal alkaryl sulfonate. Aqueous ammonia is also known as ammonium hydroxide, ammonia water or aqua ammonia and is produced by contacting ammonia with water. Ammonia is readily soluble in water to produce a solution with alkaline characteristics.

Since the functional component in the aqueous solution is the ammonium ion, this ion may also be supplied in an aqueous solution by a soluble ammonium salt. Suitable ammonium salts are, of course, those salts which are soluble in water and are otherwise convenient. In accordance with the present invention, a preferred water soluble ammonium salt is ammonium chloride. Ammonium chloride is a white salt, with a bitter, salty taste. The ammonium ion concentration in the aqueous solution is not critical to the present invention and may be easily adjusted or selected by those skilled in the art to give the desired results.

According to the present invention, the hydrocarbon solution of metal alkaryl sulfonate is contacted with aqueous ammonia or an aqueous ammonium salt solution at conditions which preferably include a temperature from about 75° F. to about 400° F., more preferably from about 100° F. to about 250° F. and a pressure from about ambient to about 500 psig, more preferably from about ambient to about 250 psig. It is preferred that the temperature and pressure be selected and coordinated to ensure that the contacting procedure is conducted essentially in a liquid phase. This contacting may be accomplished by using any convenient technique for intimately contacting two immiscible liquids. Such contacting may be a continuous or a batch type operation.

Generally the duration of the contact procedure is determined by the degree of metal removal desired. Preferred contact times range from about 0.1 to about 100 hours and more preferably from about 0.1 to about 20 hours.

After the contacting of the hydrocarbon with the aqueous solution and the resulting removal of metal from the hydrocarbon, the hydrocarbon phase and the aqueous phase are permitted to separate and are then decanted to yield a hydrocarbon having a reduced metal content. Any other suitable method known to the art, or otherwise, may be used to recover the desired hydrocarbon phase.

The method of the present invention is further illustrated by the following example which is a preferred embodiment and is not intended as an undue limitation on the generally broad scope of the invention as set out in the appended claims.

EXAMPLE

A vacuum column resid was selected to demonstrate a preferred embodiment of the present invention. An inspection of the resid is presented in Table I.

TABLE I

Inspection of Vacuum Column Resid Containing Sodium Alkaryl Sulfonate

| | |
|---|---|
| API Gravity at 60° F. | 13 |
| Distillation (D-1160) | |
| IBP, °F. | 826 |
| 5% | 902 |
| 10% | 939 |
| 30% | 1004 |
| EP | 1004 (34%) |
| Viscosity | |
| Kinematic @ 122° F. | 425.8 |
| Sulfur, wt. % | 0.6 |
| Nitrogen, wt. % | 0.39 |
| Conradson Carbon, wt. % | 10.8 |
| Heptane Insolubles, wt. % | 5.38 |
| Salt as NaCl, lbs/M Bbls | 295 |
| Arsenic, ppm | 1 |
| Metals by Emission, ppm | |
| Fe | 63 |
| Ni | 4.9 |
| V | 13 |
| Pb | 5.9 |
| Cu | 0.89 |
| Na | 540 |
| Mo | 0.1 |
| Ca | 150 |
| Mg | 16 |
| Methylene Blue Test, wt. % | 0.69 |

This vacuum resid had a sodium alkaryl sulfonate content of 0.69 weight percent as measured by the standard Methylene Blue Test, and a sodium concentration of 540 parts per million by weight. About 205 cc of the hereinabove described vacuum resid was added to 195 cc of 5 molar aqueous ammonium chloride solution which had previously been adjusted to a pH equal to 1 with hydrochloric acid. This mixture was stirred overnight at a temperature of 140° F. Then 254 cc of toluene diluent was stirred into the vacuum resid-aqueous admixture. After standing, an oil phase and an aqueous phase were recovered. The recovered vacuum resid was analyzed by the Methylene Blue Test and was found to contain 0.68 weight percent ammonium alkaryl sulfonate which represents only a 1.4 percent removal of alkaryl sulfonate. However, the recovered vacuum resid contained only 15 weight parts per million of sodium or a 97.2% reduction of sodium from the alkaryl sulfonate. As further evidence of the removal of sodium from the vacuum resid, the recovered aqueous phase was found to contain 1000 weight ppm sodium.

The foregoing specification and example clearly illustrate the improvements encompassed by the present invention and the benefits to be afforded therefrom.

We claim:

1. A method for the removal of metal from a hydrocarbon solution containing metal alkaryl sulfonate, which method comprises:
   (a) contacting a hydrocarbon solution of metal alkaryl sulfonate with aqueous ammonia or aqueous ammonium salt solution; and
   (b) recovering a hydrocarbon having a reduced metal concentration.

2. The method of claim 1 wherein said hydrocarbon is crude oil.

3. The method of claim 1 wherein said metal alkaryl sulfonate is present in the hydrocarbon solution in an amount from about 10 parts per million by weight to about 10,000 parts per million by weight.

4. The method of claim 1 wherein step (a) is performed at a temperature from about 100° F. to about 250° F.

5. The method of claim 1 wherein step (a) is performed at a pressure from about ambient to about 250 psig.

6. The method of claim 1 wherein said metal alkaryl sulfonate is sodium alkaryl sulfonate.

7. The method of claim 1 wherein said ammonium salt is ammonium chloride.

8. A method for the removal of sodium from a hydrocarbon solution containing sodium alkaryl sulfonate, which method comprises:

(a) contacting a hydrocarbon solution of sodium alkaryl sulfonate with an aqueous solution of ammonium chloride at a temperature from about 100° F. to about 250° F. and a pressure from about ambient to about 250 psig; and (b) recovering a hydrocarbon having a reduced sodium concentration.

* * * * *